US010681993B2

(12) United States Patent
Mountz et al.

(10) Patent No.: US 10,681,993 B2
(45) Date of Patent: Jun. 16, 2020

(54) SWING SEAT

(71) Applicant: Wonderland Switzerland AG, Steinhausen (CH)

(72) Inventors: Jonathan K. Mountz, Elverson, PA (US); Nathanael Saint, Morgantown, PA (US)

(73) Assignee: WONDERLAND SWITZERLAND AG, Steinhausen (CH)

( * ) Notice: Subject to any disclaimer, the term of this patent is extended or adjusted under 35 U.S.C. 154(b) by 0 days.

(21) Appl. No.: 16/438,845

(22) Filed: Jun. 12, 2019

(65) Prior Publication Data

US 2019/0380510 A1 Dec. 19, 2019

Related U.S. Application Data

(60) Provisional application No. 62/685,033, filed on Jun. 14, 2018.

(51) Int. Cl.

| | |
|---|---|
| ***A63G 9/16*** | (2006.01) |
| ***A47D 13/10*** | (2006.01) |
| ***A47D 13/02*** | (2006.01) |
| *A47D 13/00* | (2006.01) |

(52) U.S. Cl.

CPC ..... *A47D 13/105* (2013.01); *A47D 13/025* (2013.01)

(58) Field of Classification Search

CPC ... A63G 9/00; A63G 9/16; A47D 9/00; A47D 9/02; A47D 13/00; A47D 13/105; A47D 13/02; A47D 13/025; A47D 13/10

USPC ..... 472/118–119, 125; 297/273, 274

See application file for complete search history.

(56) References Cited

U.S. PATENT DOCUMENTS

| | | | | |
|---|---|---|---|---|
| 6,027,409 A * | 2/2000 | Favorito | ..... | A47D 13/105 472/118 |
| 6,386,986 B1 * | 5/2002 | Sonner | ..... | A47D 9/02 297/273 |
| 7,422,524 B2 * | 9/2008 | Gregorian | ..... | A47D 9/04 472/119 |

(Continued)

FOREIGN PATENT DOCUMENTS

| | | |
|---|---|---|
| CN | 105105569 A | 12/2015 |
| GB | 2399769A A | 9/2004 |

(Continued)

OTHER PUBLICATIONS

Search Report issued to U.K. counterpart application No. GB19085042 by the U.K. Intellectual Property Office dated Oct. 11, 2019.

*Primary Examiner* — Kien T Nguyen

(74) *Attorney, Agent, or Firm* — Hamre, Schumann, Mueller & Larson, P.C.

(57) ABSTRACT

A swing seat includes a frame assembly and a seat assembly. The frame assembly includes a frame unit, and a rotating unit that is connected to a top end of the frame unit and that is rotatable relative to the frame unit about a swing axis which extends in an axial direction. The seat assembly includes a seat member, and a hanger arm. The hanger arm has a hanger portion coupled removably and co-movably to the rotating unit of the frame assembly, and a connecting portion interconnecting the hanger portion and the seat member, such that the seat member is swingable relative to the frame unit of the frame assembly about the swing axis.

15 Claims, 14 Drawing Sheets

(56) References Cited

U.S. PATENT DOCUMENTS

| | | | | |
|---|---|---|---|---|
| 7,445,560 | B2 * | 11/2008 | Greger | A47D 13/102 297/273 |
| 7,748,063 | B2 * | 7/2010 | Chen | A47D 13/105 297/260.2 |
| 2004/0102253 | A1 | 5/2004 | Ransil et al. | |
| 2006/0252564 | A1 | 11/2006 | Bellows et al. | |
| 2011/0028228 | A1 | 2/2011 | Zhang | |

FOREIGN PATENT DOCUMENTS

| | | | |
|---|---|---|---|
| GB | 2484185 | A | 4/2012 |
| KR | 10-2007-0016006 | A | 2/2007 |

* cited by examiner

SWING SEAT

CROSS-REFERENCE TO RELATED APPLICATION

This application claims priority of U.S. Provisional Patent Application No. 62/685,033, filed on Jun. 14, 2018.

FIELD

The disclosure relates to a swing seat, and more particularly to a swing seat with a removable seat assembly for young children.

BACKGROUND

A conventional infant swing is typically designed to provide a soothing swing motion for a young child. The swing is generally bulky in size due to the need for a large, stable frame to support a suspended seat, and is therefore typically confined to a set location in a home. One of the difficulties of the conventional swing is that a caretaker is unable to move the swing with the child in the seat due to its bulkiness and its inflexibility to fit in different living spaces.

SUMMARY

Therefore, the object of the disclosure is to provide a swing seat that can alleviate at least one of the drawbacks of the prior art.

According to the disclosure, a swing seat includes a frame assembly and a seat assembly.

The frame assembly includes a frame unit, and a rotating unit that is connected to a top end of the frame unit and that is rotatable relative to the frame unit about a swing axis which extends in an axial direction. The seat assembly includes a seat member, and a hanger arm. The hanger arm has a hanger portion coupled removably and co-movably to the rotating unit of the frame assembly, and a connecting portion interconnecting the hanger portion and the seat member, such that the seat member is swingable relative to the frame unit of the frame assembly about the swing axis.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
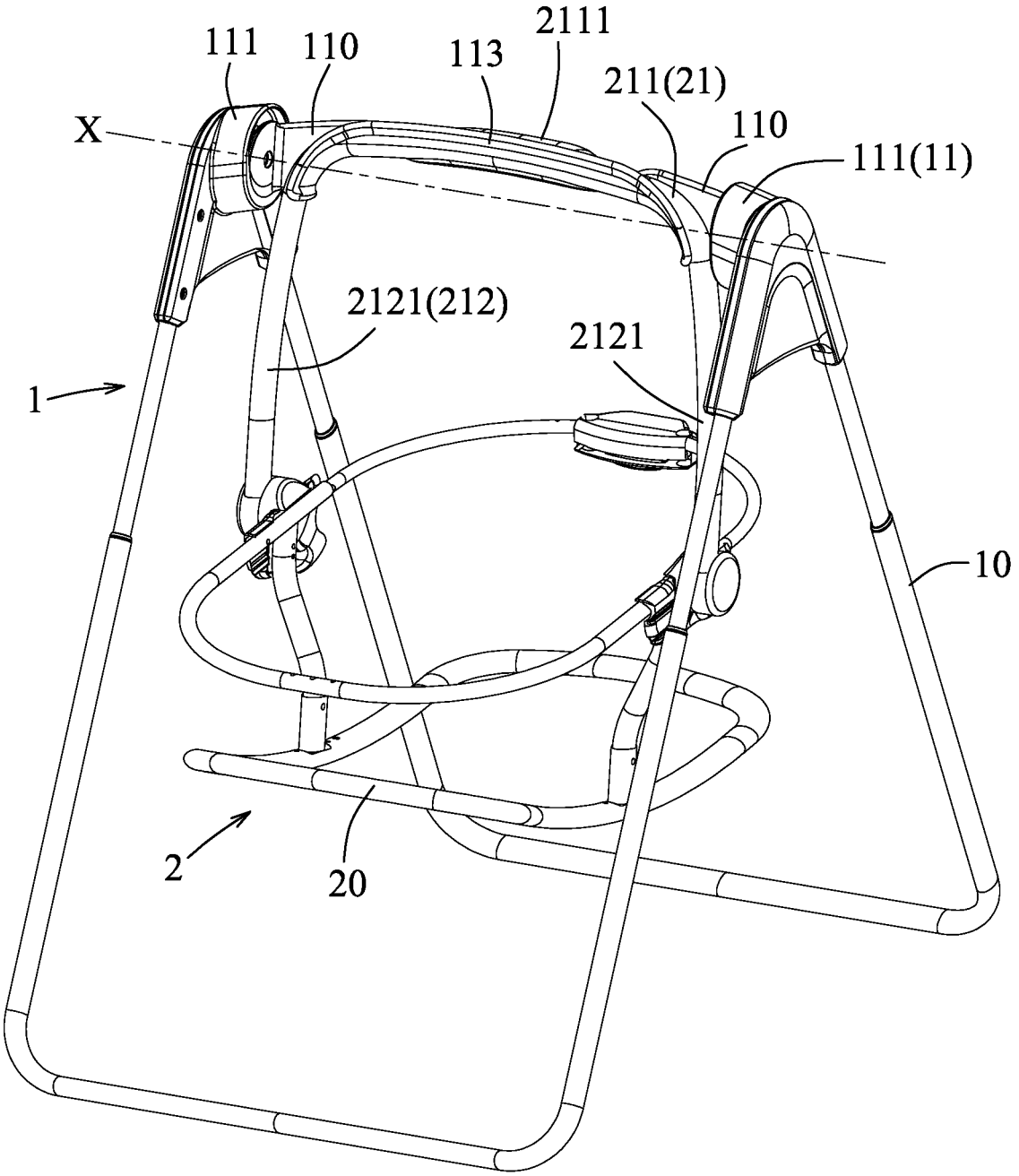
FIG. 1 is an assembled perspective view of a first embodiment of a swing seat according to the disclosure.

Before the present disclosure is described in greater detail, it should be noted that where considered appropriate, reference numerals or terminal portions of reference numerals have been repeated among the figures to indicate corresponding or analogous elements, which may optionally have similar characteristics.

Figure 2:
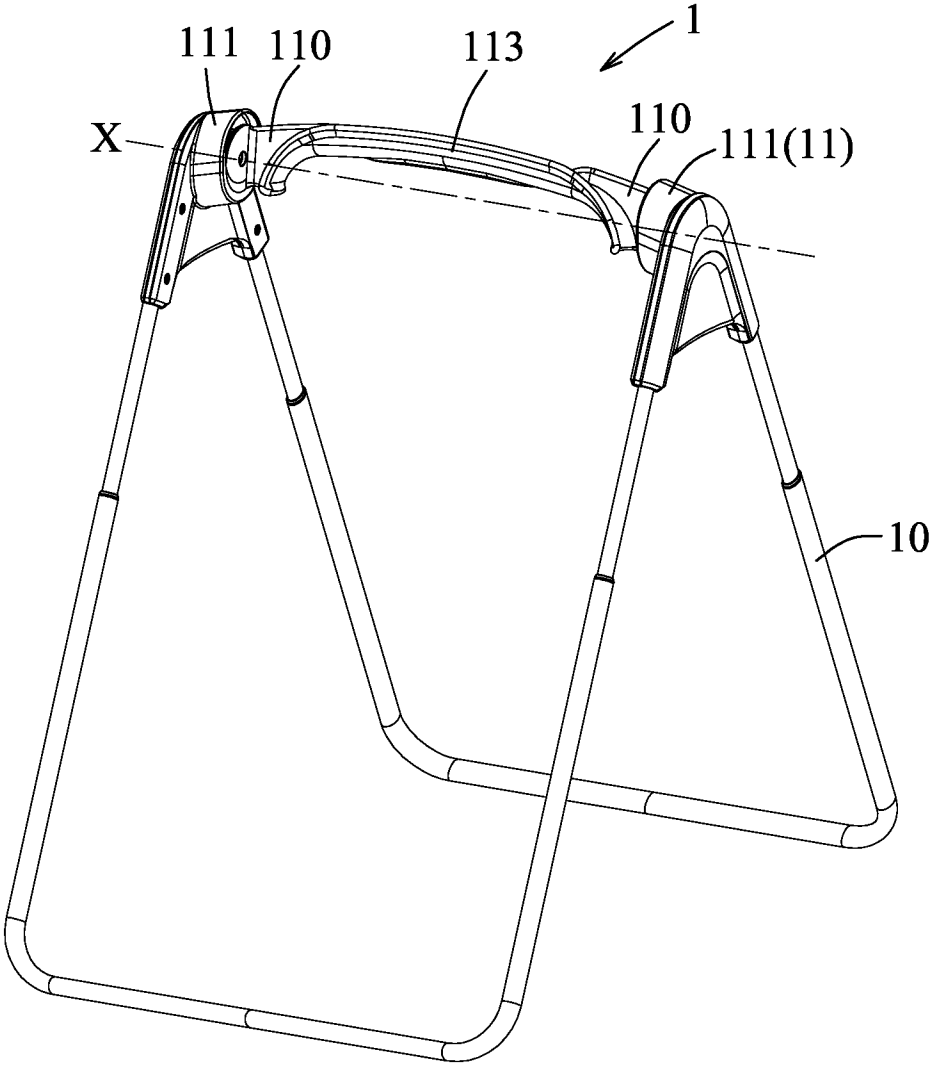
FIG. 2 is a partly exploded perspective view of the first embodiment.
Figure 2:
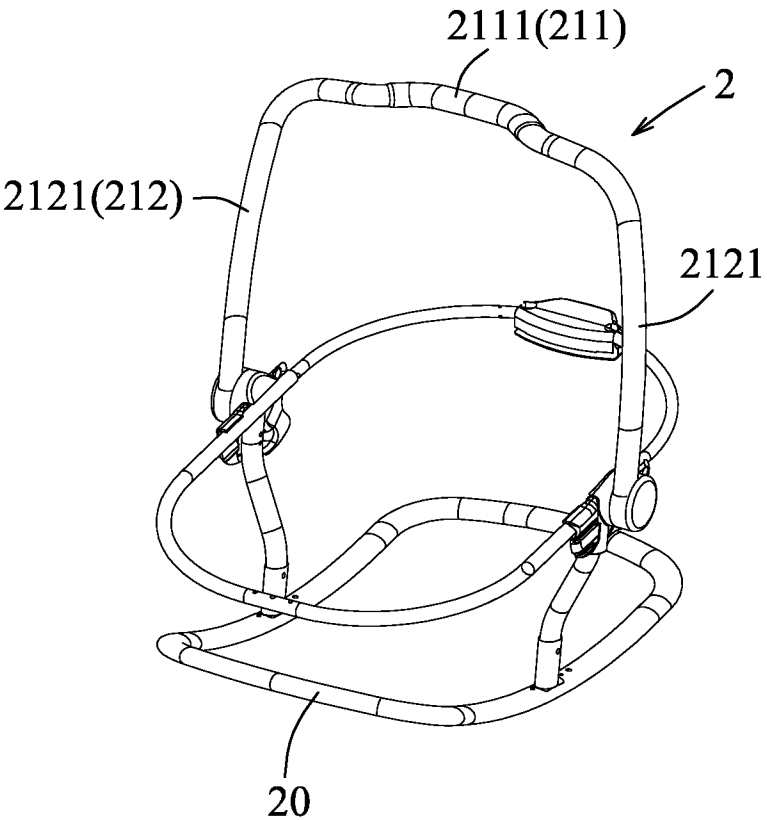
Figure 3:
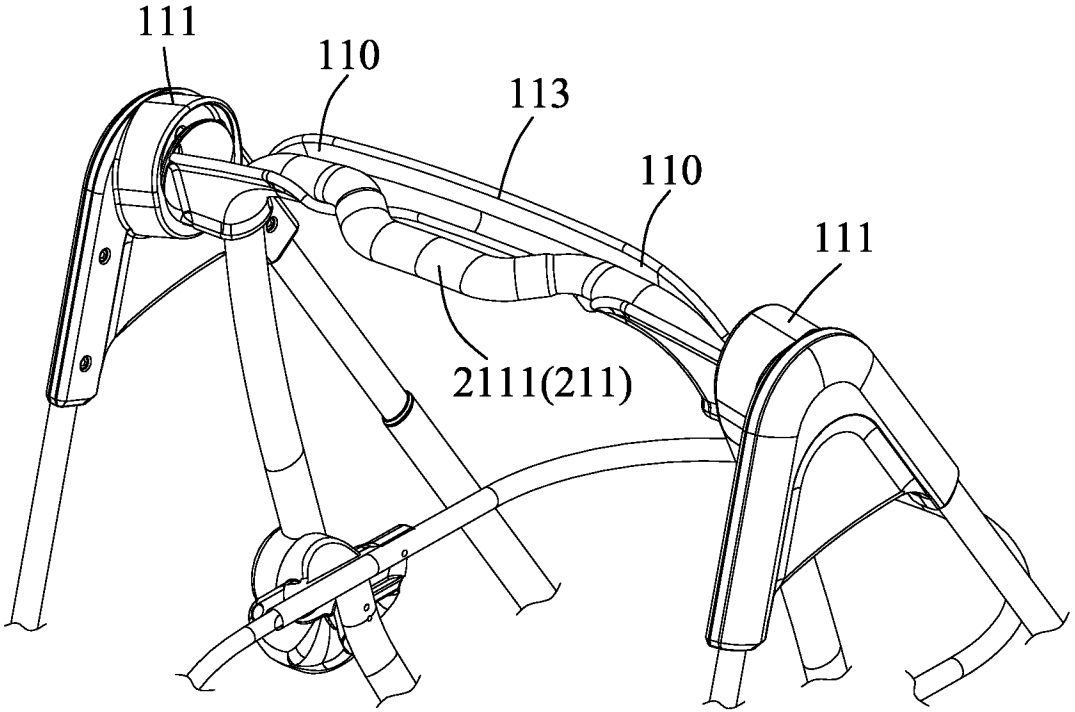
FIG. 3 is a fragmentary perspective view of the first embodiment.

Referring to FIGS. 1 to 3, a first embodiment of a swing seat according to the disclosure includes a frame assembly 1 and a seat assembly 2.

The frame assembly 1 includes a frame unit 10, and a rotating unit 11 that is connected to a top end of the frame unit 10 and that is rotatable relative to the frame unit 10 about a swing axis (X) which extends in an axial direction.

The seat assembly 2 includes a seat member 20, and a hanger arm 21 that has a hanger portion 211 and a connecting portion 212. The hanger portion 211 is coupled removably and co-movably to the rotating unit 11 of the frame assembly 1. The connecting portion 212 interconnects the hanger portion 211 and the seat member 20, such that the seat member 20 is swingable relative to the frame unit 10 of the frame assembly 1 about the swing axis (X). The seat member 20 is adapted to be mounted with, for example, an infant carrier, and has a bottom portion having two opposite ends that are bent upwardly, such that when the seat assembly 2 is detached from the frame assembly 1, the seat assembly 2 may be used as a standalone rocker.

In this embodiment, the hanger arm 21 is a U-shaped arm. The hanger portion 211 of the hanger arm 21 is substantially parallel to the swing axis (X) and has opposite ends in the axial direction. The connecting portion 212 of the hanger arm 21 has two connecting segments 2121 that are respectively and transversely connected to the opposite ends of the hanger portion 211 of the hanger arm 21, and that are connected to the seat member 20.

In this embodiment, the rotating unit 11 of the frame assembly 1 includes two rotating members 111 that are spaced apart from each other in the axial direction. Each of the rotating members 111 defines an engaging channel 110. The opposite ends of the hanger portion 211 of the hanger arm 21 engage respectively and removably the engaging channels 110 of the rotating members 111.

It should be noted, in this embodiment, the rotating unit 11 further includes a linking member 113 that extends in the axial direction, that interconnects the rotating members 111, and that is molded as one piece with the rotating members 111. The hanger portion 211 further has a jog segment 2111 that is disposed between the opposite ends of the hanger portion 211, and that cooperates with the linking member 113 of the rotating unit 11 to define a gap therebetween.

In virtue of the abovementioned configuration of the seat assembly 2, a caretaker can easily remove the hanger portion 211 of the seat assembly 2 from the engaging channels 110 of the frame assembly 1 by extending a hand through the gap between the jog segment 2111 of the hanger portion 211 of the hanger arm 21 and the linking member 113 of rotating unit 11, and grasping and lifting the jog segment 2111 of the hanger portion 211, so that the seat assembly 2 can be carried about a home and used as a standalone infant seat or rocker. Conversely, to mount the seat assembly 2 onto the frame assembly 1, the caretaker may simply reverse the abovementioned process, and the swing seat will be ready for use.

Figure 4:
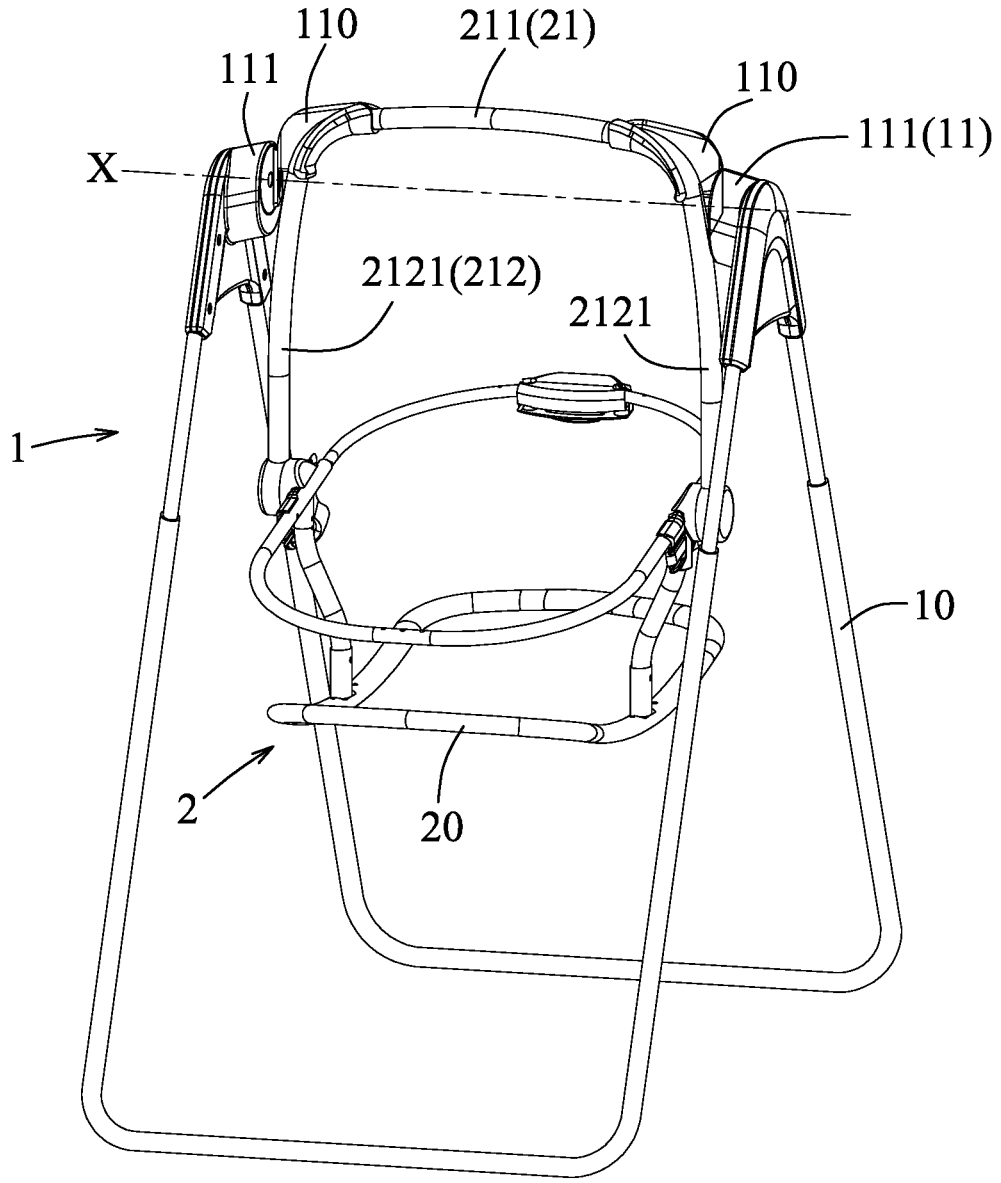
FIG. 4 is an assembled perspective view of a second embodiment of the swing seat according to the disclosure.
Figure 5:
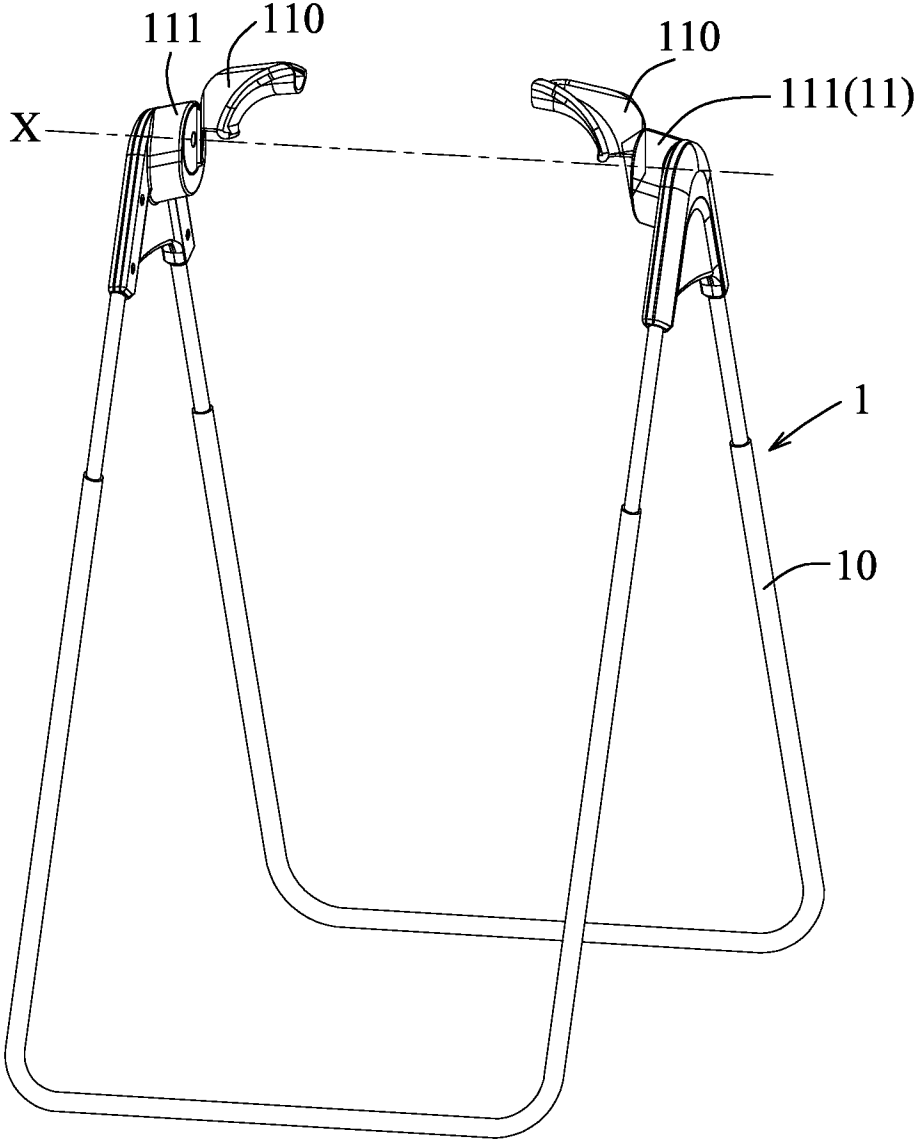
FIG. 5 is a partly exploded perspective view of the second embodiment.
Figure 5:
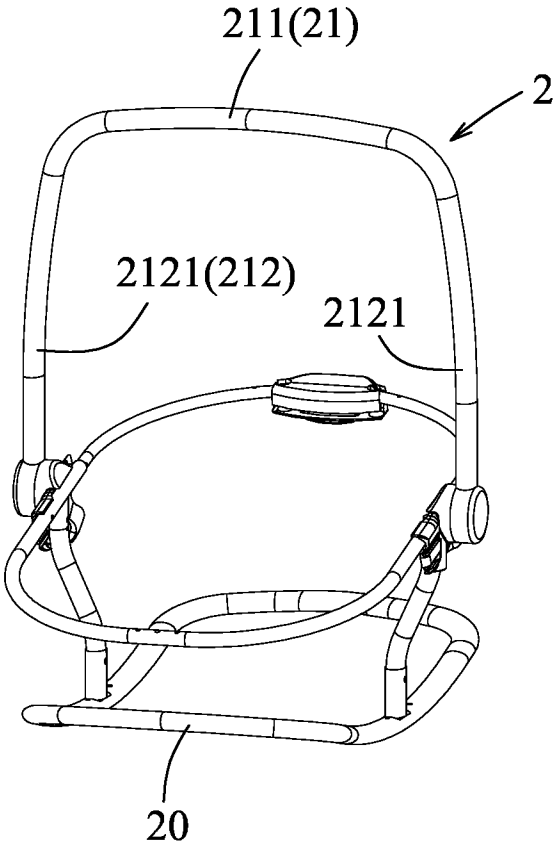

Referring to FIGS. 4 and 5, a second embodiment of the swing seat is similar to the first embodiment. The difference between the two embodiments resides in the configurations of the rotating unit 11 of the frame assembly 1 and the hanger portion 211 of the hanger arm 21 of the seat assembly 2.

In this embodiment, the two rotating members 111 remain separated with the linking member 113 of the previous embodiment being omitted, and the hanger portion 211 of the hanger arm 21 does not have the jog segment 2111. Moreover, when the opposite ends of the hanger portion 211 engage respectively the engaging channels 110 of the rotating members 111, the hanger portion 211 is disposed above the swing axis (X).

Figure 6:
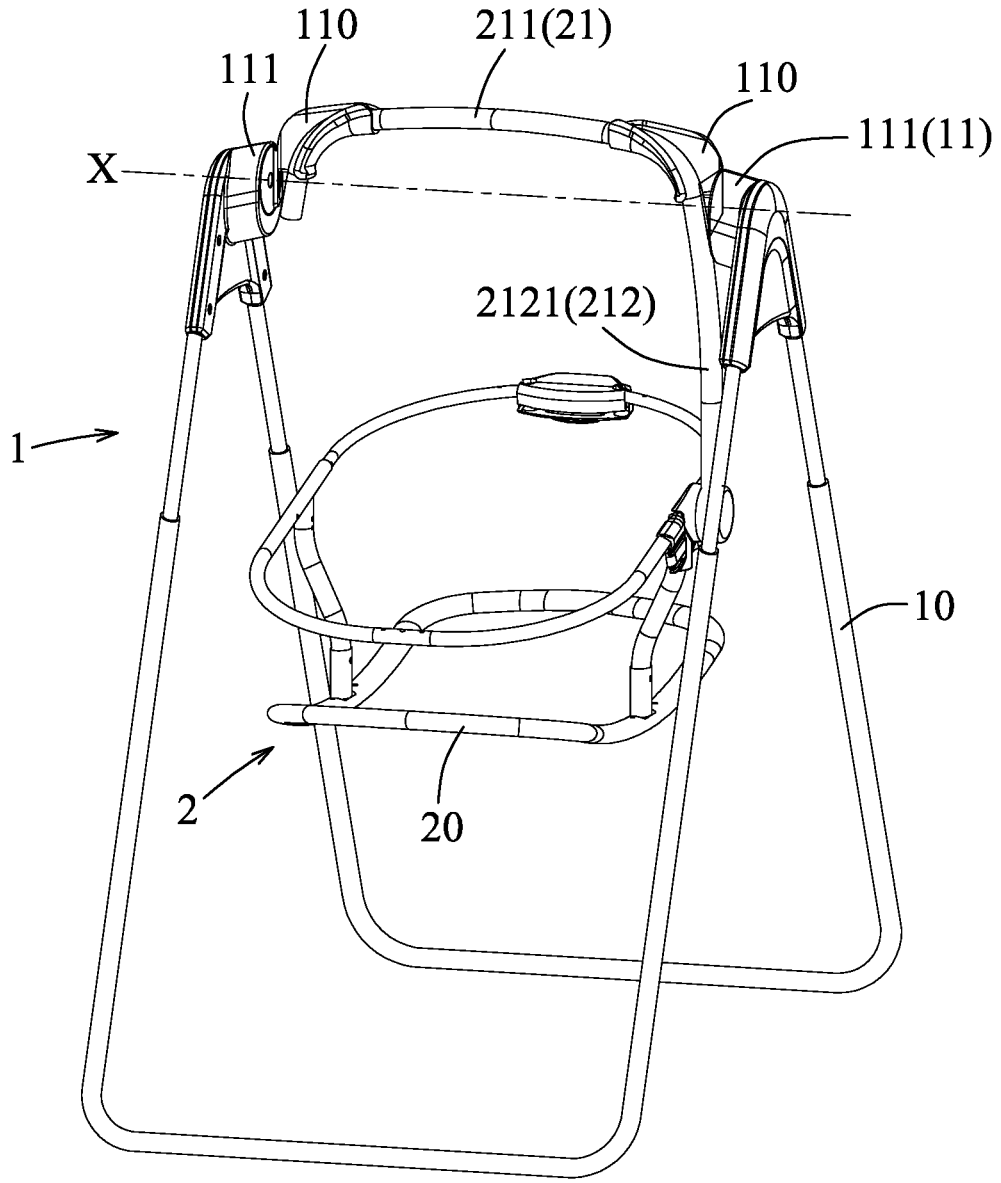
FIG. 6 is an assembled perspective view of a third embodiment of the swing seat according to the disclosure.
Figure 7:
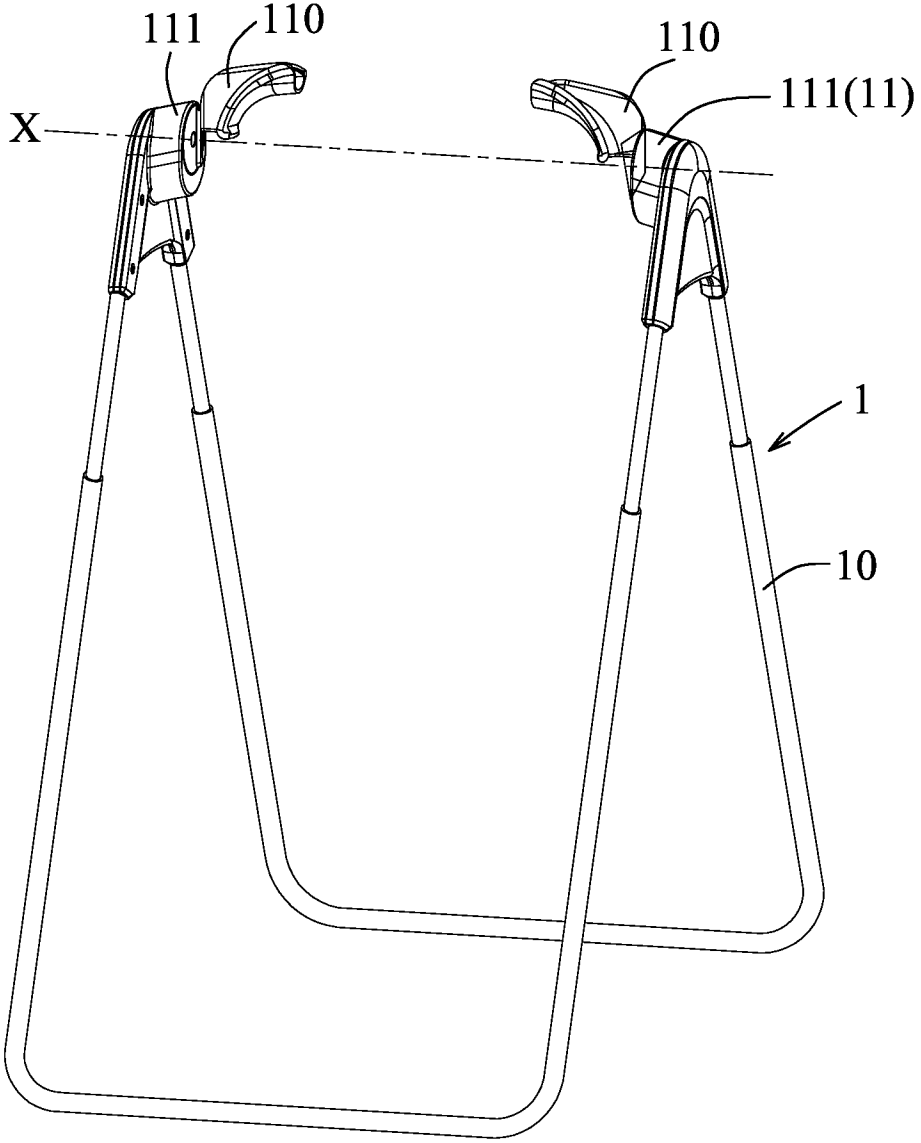
FIG. 7 is a fragmentary exploded perspective view of the third embodiment.
Figure 7:
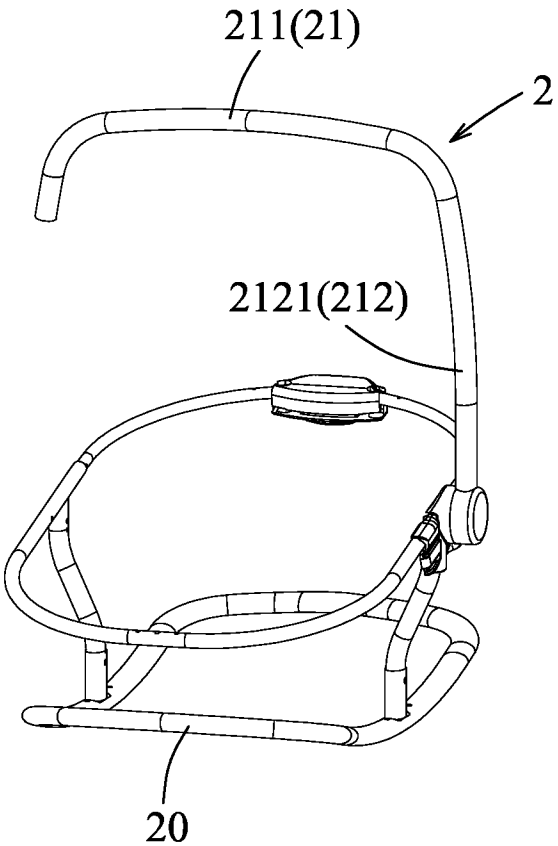

Referring to FIGS. 6 and 7, a third embodiment of the swing seat is similar to the second embodiment. The difference between the two embodiments resides in the configuration of the hanger arm 21 of the seat assembly 2.

In this embodiment, the hanger arm 21 is an inverted J-shaped arm, that is, the connecting portion 212 of the hanger arm 21 has only one connecting segment 2121 that is connected transversely to one of the opposite ends of the hanger portion 211 of the hanger arm 21, and that is connected to the seat member 20.

Similar to the second embodiment, the rotating unit 11 of the frame assembly 1 includes two rotating members 111 that are spaced apart from each other in the axial direction, and each of the rotating members 111 defines an engaging channel 110. The opposite ends of the hanger portion 211 of the hanger arm 21 engage respectively and removably the engaging channels 110 of the rotating members 111.

Figure 8:
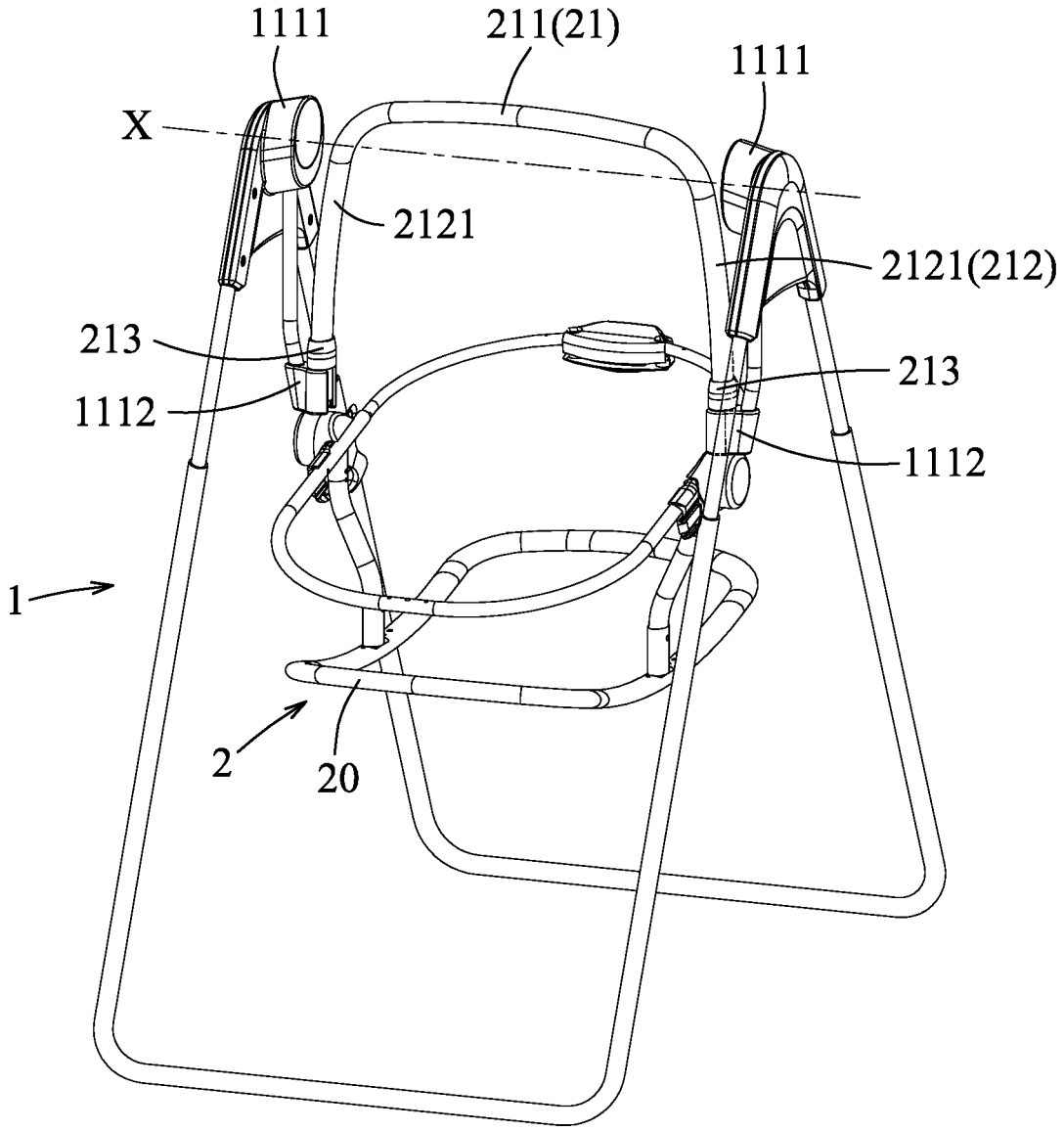
FIG. 8 is an assembled perspective view of a fourth embodiment of the swing seat according to the disclosure.
Figure 9:
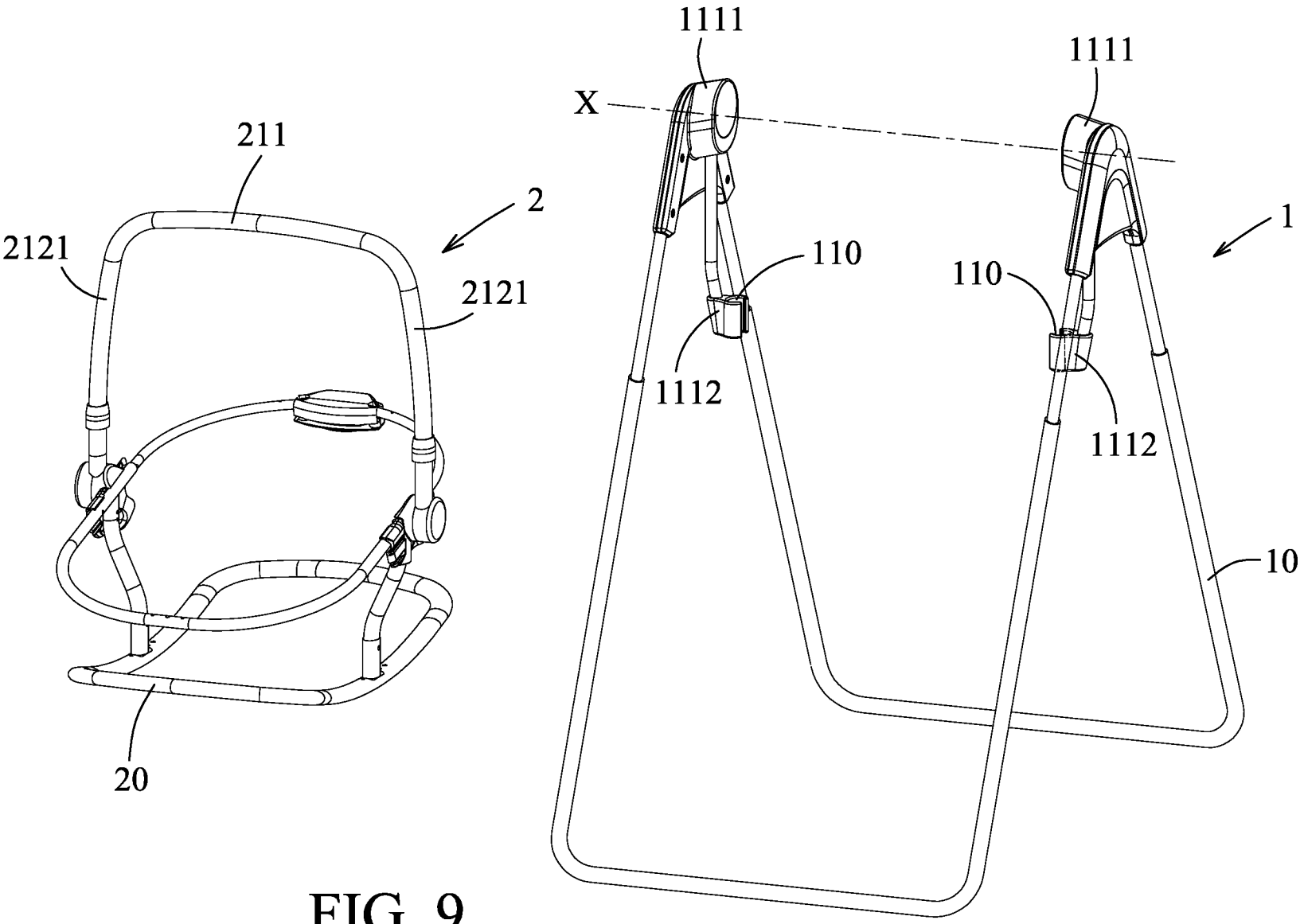
FIG. 9 is a partly exploded perspective view of the fourth embodiment.

Referring to FIGS. 8 and 9, a fourth embodiment of the swing seat is similar to the second embodiment. The difference between the two embodiments resides in the configurations of the rotating members 111 of the frame assembly 1 and the hanger arm 21 of the seat assembly 2.

In this embodiment, each of the rotating members 111 is elongated, is transverse to the swing axis (X), and has a first end 1111 connected to the frame unit 10 and a second end 1112 distal from the first end 1111 and defining the engaging channel 110. Each of the connecting segments 2121 of the connecting portion 212 of the hanger arm 21 engages removably the engaging channel 110 of a respective one of the rotating members 111 in such a manner that the hanger portion 211 of the hanger arm 21 is disposed above the swing axis (X).

The hanger arm 21 further has two stopper bushings 213 that are respectively sleeved on the connecting segments 2121 of the side portions 212 of the hanger arm 21. Each of the stopper bushings 213 abuts against the second end 1112 of a respective one of the rotating members 111 such that the hanger arm 21 is positioned relative to the rotating members 111.

More specifically, in virtue of the stopper bushings 213, when the seat member 20 swings relative to the frame unit 10 of the frame assembly 1 about the swing axis (X), each of the connecting segments 2121 of the hanger arm 21 is able to remain securely engaged in the engaging channel 110 of a respective one of the rotating members 111.

Figure 10:
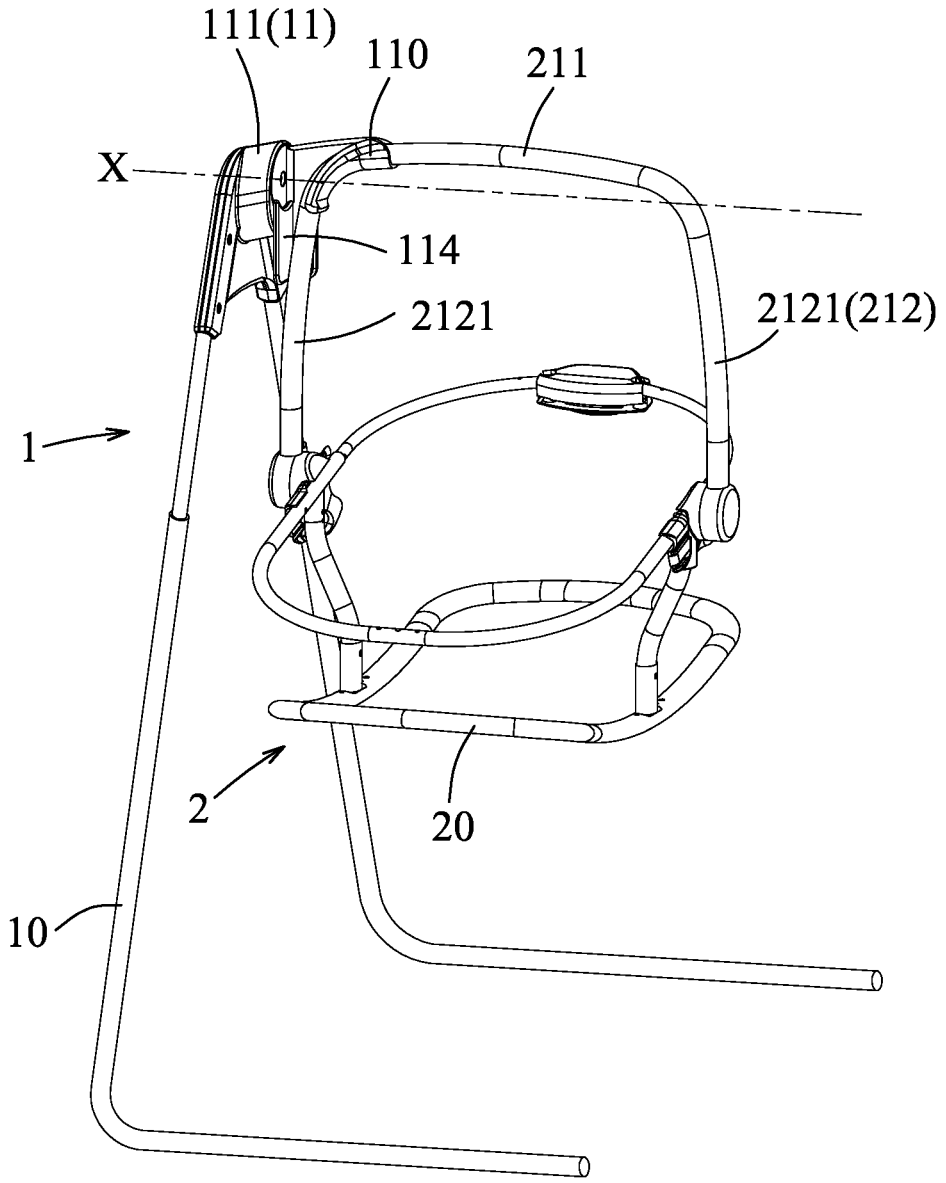
FIG. 10 is an assembled perspective view of a fifth embodiment of the swing seat according to the disclosure.
Figure 11:
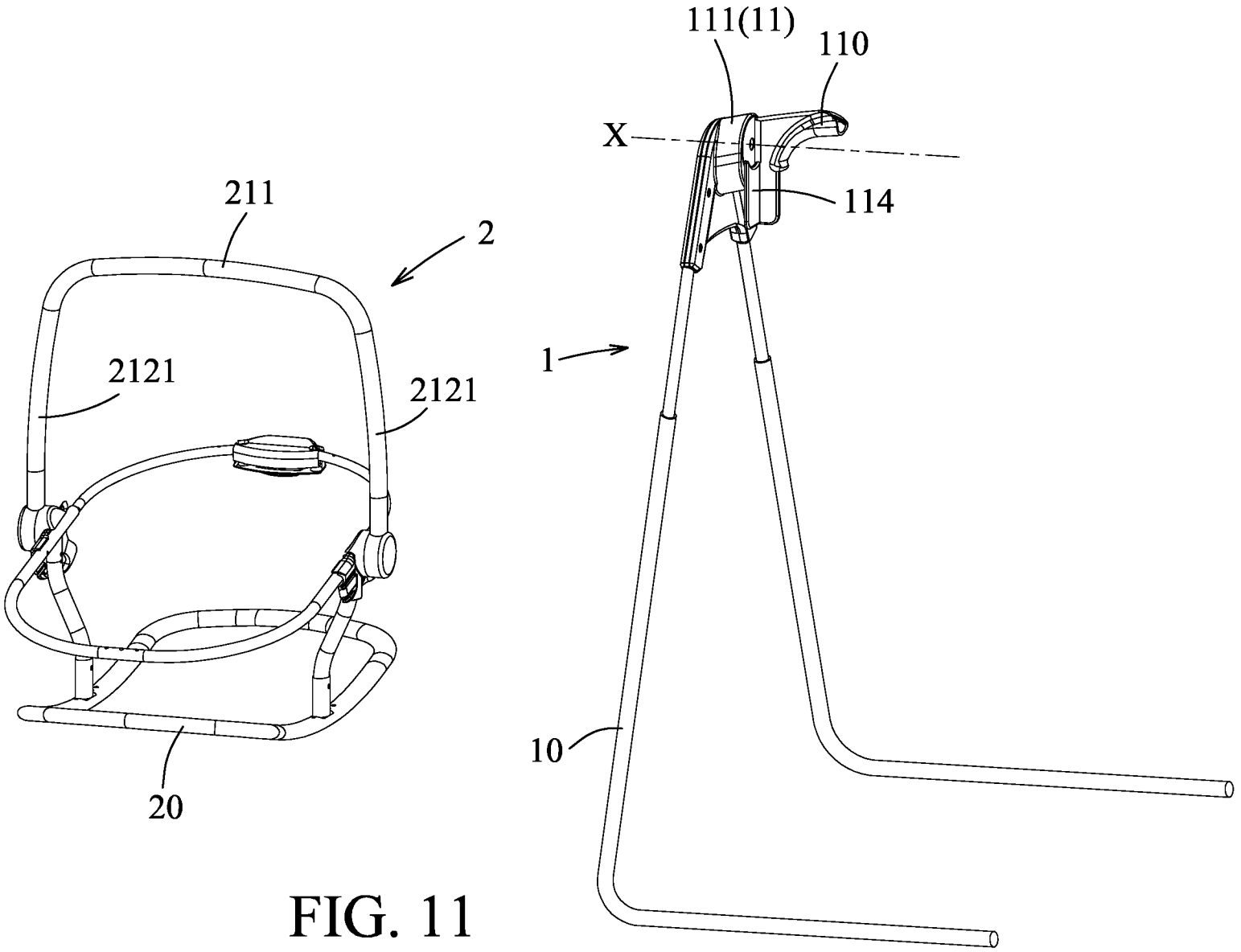
FIG. 11 is a partly exploded perspective view of the fifth embodiment.

Referring to FIGS. 10 and 11, a fifth embodiment of the swing seat is similar to the second embodiment. The difference between the two embodiments resides in the configuration of the frame assembly 1.

In this embodiment, the rotating unit 11 of the frame assembly 1 includes only one rotating member 111 defining an engaging channel 110. One of the opposite ends of the hanger portion 211 of the hanger arm 21 engages removably the engaging channel 110.

The rotating unit 11 further includes a side support 114 connected to the rotating member 111 and abutting against a corresponding one of the connecting segments 2121 of the connecting portion 212 of the hanger arm 21, such that the rotating member 111 and the side support 114 cooperatively brace and position the hanger arm 21 of the seat assembly 2 relative to the rotating unit 11.

Figure 12:
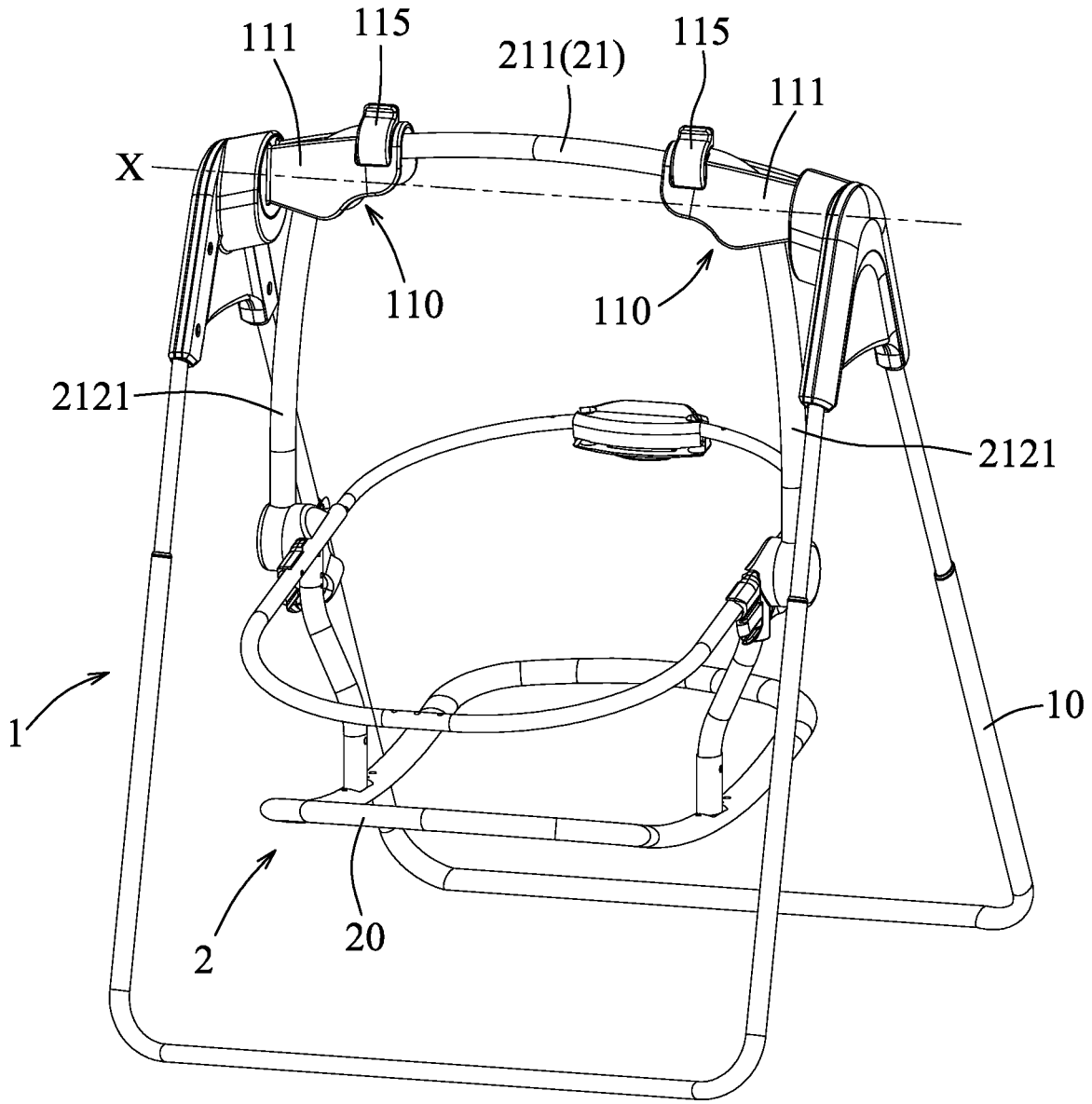
FIG. 12 is an assembled perspective view of a sixth embodiment of the swing seat according to the disclosure.
Figure 13:
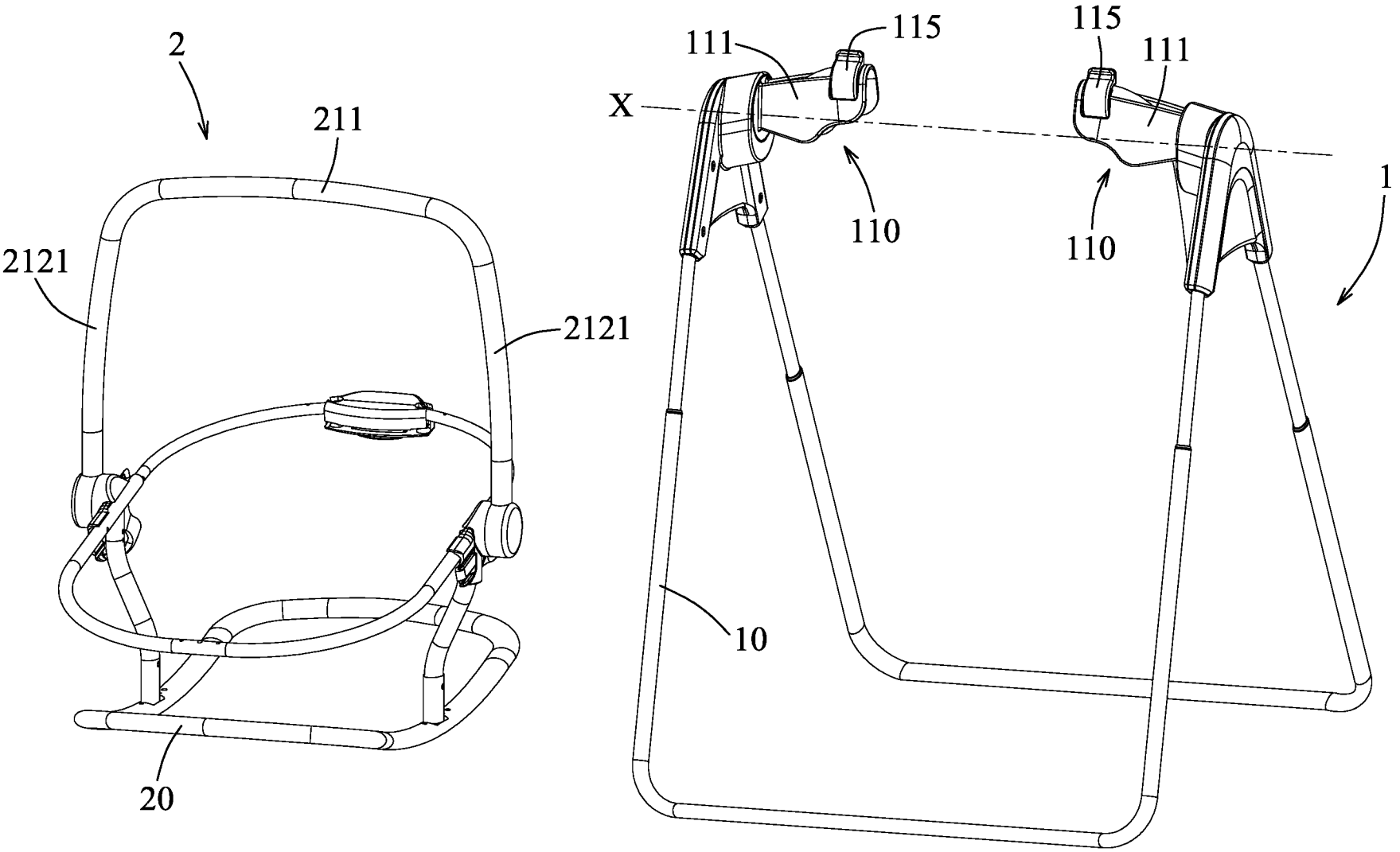
FIG. 13 is a partly exploded perspective view of the sixth embodiment.
Figure 14:
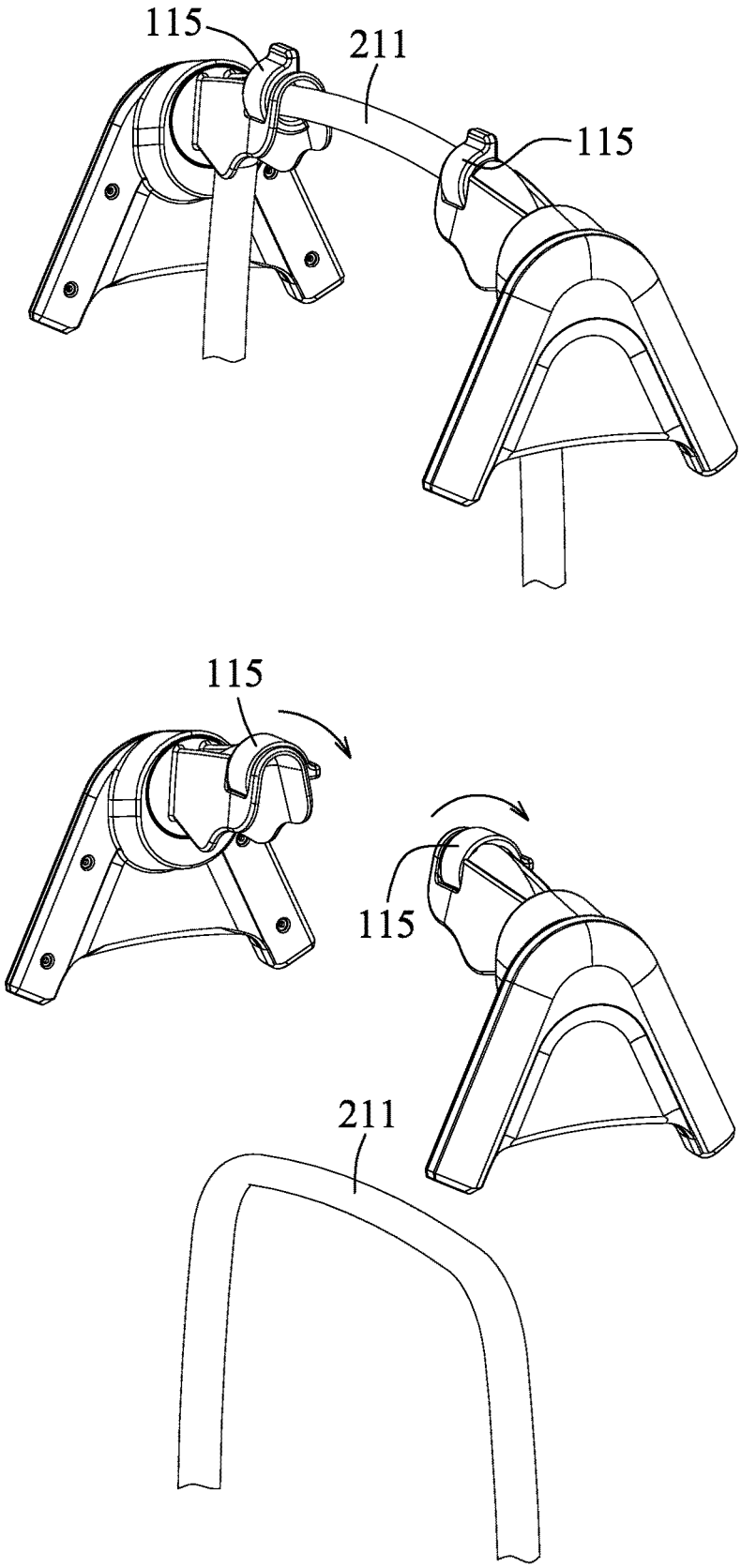
FIG. 14 is a fragmentary perspective view of the sixth embodiment illustrating two latches of the frame assembly moving between a locked position and an unlocked position.

Referring to FIGS. 12 to 14, a sixth embodiment of the swing seat is similar to the second embodiment. The difference between the two embodiments resides in the configuration of the rotating unit 11 of the frame assembly 1.

In this embodiment, the rotating unit 11 further includes two latches 115 that are connected respectively to the rotating members 111, and that are movable between a locked position and an unlocked position. When the latches 115 are at the locked position, as shown in the upper portion of FIG. 14, the engaging channels 110 of the rotating members 111 are blocked by the latches 115 so that the hanger portion 211 is locked to the rotating members 111. When the latches 115 are at the unlocked position, as shown in the lower portion of FIG. 14, removal of the opposite ends of the hanger portion 211 of the hanger arm 21 from the engaging channels 110 of the rotating members 111 is permitted.

It should be noted, in all of the abovementioned embodiments and variations thereof, the swing seat may further include a motor for driving the rotating unit 11 to initiate a swing motion of the seat member 20. Moreover, in virtue of the configuration of the seat member 20, the seat assembly 2 in all of the abovementioned embodiments and the variations thereof may be used as a standalone rocker.

In summary, the present disclosure provides a swing seat with easily removable seat assembly 2 via the hanger arm 21 that is pivotally and removably engaged with the frame assembly 1. The caretaker can easily grasp the hanger arm 21 of the seat assembly 2 and lift the seat assembly 2 away from the frame assembly 1, allowing for easy transport about living spaces and convenient use as a standalone infant seat or rocker.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A swing seat comprising:

a frame assembly including a frame unit, and a rotating unit that is connected to a top end of said frame unit and that is rotatable relative to said frame unit about a swing axis which extends in an axial direction; and a seat assembly including a seat member, and a hanger arm that has a hanger portion coupled removably and co-movably to said rotating unit of said frame assembly, and a connecting portion interconnecting said hanger portion and said seat member, such that said seat member is swingable relative to said frame unit of said frame assembly about the swing axis;

wherein said hanger arm is a U-shaped arm;

wherein said hanger portion of said hanger arm is substantially parallel to the swing axis and has opposite ends in the axial direction;

wherein said connecting portion of said hanger arm has two connecting segments that are respectively connected transversely to said opposite ends of said hanger portion of said hanger arm, and that are connected to said seat member;

wherein said rotating unit of said frame assembly includes two rotating members that are spaced apart from each other in the axial direction, each of said rotating members defining an engaging channel;

wherein said opposite ends of said hanger portion of said hanger arm engage respectively and removably said engaging channels of said rotating members;

wherein said rotating unit further includes a linking member that extends in the axial direction, and that interconnects said rotating members; and wherein said hanger portion further has a jog segment that is disposed between said opposite ends of said hanger portion, and that cooperates with said linking member of said rotating unit to define a gap therebetween.

2. The swing seat as claimed in claim 1, wherein said seat member of said seat assembly has a bottom portion having two opposite ends that are bent upwardly.

3. A swing seat comprising:

a frame assembly including a frame unit, and a rotating unit that is connected to a top end of said frame unit and that is rotatable relative to said frame unit about a swing axis which extends in an axial direction; and a seat assembly including a seat member, and a hanger arm that has a hanger portion coupled removably and co-movably to said rotating unit of said frame assembly, and a connecting portion interconnecting said hanger portion and said seat member, such that said seat member is swingable relative to said frame unit of said frame assembly about the swing axis, wherein:

said hanger arm is a U-shaped arm;

said hanger portion of said hanger arm is substantially parallel to the swing axis and has opposite ends in the axial direction; and said connecting portion of said hanger arm has two connecting segments that are respectively connected transversely to said opposite ends of said hanger portion of said hanger arm, and that are connected to said seat member, wherein:

said rotating unit of said frame assembly includes two rotating members that are spaced apart from each other in the axial direction, each of said rotating members defining an engaging channel; and said opposite ends of said hanger portion of said hanger arm engaging respectively and removably said engaging channels of said rotating members, and wherein:

each of said rotating members is elongated, is transverse to the swing axis, and has a first end connected to said frame unit and a second end distal from said first end and defining said engaging channel;

said connecting segments of said connecting portion of said hanger arm engages respectively and removably said engaging channels of said rotating members; and said hanger arm further has two stopper bushings that are respectively sleeved on said connecting segments of said side portions of said hanger arm, each stopper bushings abutting against said second end of a respective one of said rotating members such that said hanger arm is positioned relative to said rotating members.

4. The swing seat as claimed in claim 3, wherein said hanger portion of said hanger arm is disposed above the swing axis.

5. The swing seat as claimed in claim 3, wherein said seat member of said seat assembly has a bottom portion having two opposite ends that are bent upwardly.

6. A swing seat comprising:

a frame assembly including a frame unit, and a rotating unit that is connected to a top end of said frame unit and that is rotatable relative to said frame unit about a swing axis which extends in an axial direction; and a seat assembly including a seat member, and a hanger arm that has a hanger portion coupled removably and co-movably to said rotating unit of said frame assembly, and a connecting portion interconnecting said hanger portion and said seat member, such that said seat member is swingable relative to said frame unit of said frame assembly about the swing axis, wherein:

said hanger arm is a U-shaped arm;

said hanger portion of said hanger arm is substantially parallel to the swing axis and has opposite ends in the axial direction; and said connecting portion of said hanger arm has two connecting segments that are respectively connected transversely to said opposite ends of said hanger portion of said hanger arm, and that are connected to said seat member, wherein:

said rotating unit of said frame assembly includes two rotating members that are spaced apart from each other in the axial direction, each of said rotating members defining an engaging channel; and said opposite ends of said hanger portion of said hanger arm engaging respectively and removably said engaging channels of said rotating members, and wherein said rotating unit further includes two latches that are connected respectively to said rotating members, and that are movable between an unlocked position, where removal of said opposite ends of said hanger portion of said hanger arm from said engaging channels of said rotating members is permitted, and a locked position, where said engaging channels of said rotating members are blocked by said latches so that said hanger portion is locked to said rotating members.

7. The swing seat as claimed in claim 6, wherein said seat member of said seat assembly has a bottom portion having two opposite ends that are bent upwardly.

8. A swing seat comprising:

a frame assembly including a frame unit, and a rotating unit that is connected to a top end of said frame unit and that is rotatable relative to said frame unit about a swing axis which extends in an axial direction; and a seat assembly including a seat member, and a hanger arm that has a hanger portion coupled removably and co-movably to said rotating unit of said frame assembly, and a connecting portion interconnecting said hanger portion and said seat member, such that said seat member is swingable relative to said frame unit of said frame assembly about the swing axis, wherein:

said hanger arm is a U-shaped arm;

said hanger portion of said hanger arm is substantially parallel to the swing axis and has opposite ends in the axial direction; and said connecting portion of said hanger arm has two connecting segments that are respectively connected transversely to said opposite ends of said hanger portion of said hanger arm, and that are connected to said seat member, wherein:

said rotating unit of said frame assembly includes one rotating member defining an engaging channel;

one of said opposite ends of said hanger portion of said hanger arm engages removably said engaging channel, and wherein said rotating unit further includes a side support connected to said rotating member and abutting against a corresponding one of said connecting segments of said connecting portion of said hanger arm.

9. The swing seat as claimed in claim 8, wherein said seat member of said seat assembly has a bottom portion having two opposite ends that are bent upwardly.

10. A swing seat comprising:

a frame assembly including a frame unit, and a rotating unit that is connected to a top end of said frame unit and that is rotatable relative to said frame unit about a swing axis which extends in an axial direction; and a seat assembly including a seat member, and a hanger arm that has a hanger portion coupled removably and co-movably to said rotating unit of said frame assembly, and a connecting portion interconnecting said hanger portion and said seat member, such that said seat member is swingable relative to said frame unit of said frame assembly about the swing axis, wherein:

said hanger arm is a U-shaped arm;

said hanger portion of said hanger arm is substantially parallel to the swing axis and has opposite ends in the axial direction; and said connecting portion of said hanger arm has two connecting segments that are respectively connected transversely to said opposite ends of said hanger portion of said hanger arm, and that are connected to said seat member, and wherein said hanger portion of said hanger arm is disposed above the swing axis.

11. The swing seat as claimed in claim 10, wherein said seat member of said seat assembly has a bottom portion having two opposite ends that are bent upwardly.

12. A swing seat comprising:

a frame assembly including a frame unit, and a rotating unit that is connected to a top end of said frame unit and that is rotatable relative to said frame unit about a swing axis which extends in an axial direction; and a seat assembly including a seat member, and a hanger arm that has a hanger portion coupled removably and co-movably to said rotating unit of said frame assembly, and a connecting portion interconnecting said hanger portion and said seat member, such that said seat member is swingable relative to said frame unit of said frame assembly about the swing axis, wherein:

said hanger arm is an inverted J-shaped arm;

said hanger portion of said hanger arm is substantially parallel to the swing axis and has opposite ends in the axial direction; and said connecting portion of said hanger arm has one connecting segment that is connected transversely to one of said opposite ends of said hanger portion of said hanger arm, and that is connected to said seat member.

13. The swing seat as claimed in claim 12, wherein:

said rotating unit of said frame assembly includes two rotating members that are spaced apart from each other in the axial direction, each of said rotating members defining an engaging channel; and said opposite ends of said hanger portion of said hanger arm engage respectively and removably said engaging channels of said rotating members.

14. The swing seat as claimed in claim 12, wherein said hanger portion of said hanger arm is disposed above the swing axis.

15. The swing seat as claimed in claim 12, wherein said seat member of said seat assembly has a bottom portion having two opposite ends that are bent upwardly.

* * * * *